US007914628B2

(12) United States Patent
Tsuji et al.

(10) Patent No.: US 7,914,628 B2
(45) Date of Patent: Mar. 29, 2011

(54) MAGNETIC REFRIGERATION MATERIAL AND METHOD OF MANUFACTURING THEREOF

(75) Inventors: Hideyuki Tsuji, Yokohama (JP); Akiko Saito, Kawasaki (JP); Tadahiko Kobayashi, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 474 days.

(21) Appl. No.: 11/365,683

(22) Filed: Mar. 2, 2006

(65) Prior Publication Data

US 2006/0213580 A1 Sep. 28, 2006

(30) Foreign Application Priority Data

Mar. 24, 2005 (JP) ..... 2005-085542

(51) Int. Cl.
*H01F 1/053* (2006.01)

(52) U.S. Cl. ..... 148/301; 62/3.1; 62/6

(58) Field of Classification Search ..... None
See application file for complete search history.

(56) References Cited

U.S. PATENT DOCUMENTS

| | | | | |
|---|---|---|---|---|
| 6,676,772 | B2 | 1/2004 | Saito et al. | |
| 7,069,729 | B2 * | 7/2006 | Bruck et al. | 62/3.1 |
| 2003/0051774 | A1 * | 3/2003 | Saito et al. | 148/302 |
| 2004/0079446 | A1 | 4/2004 | Kogure et al. | |
| 2004/0194855 | A1 | 10/2004 | Fukamichi et al. | |
| 2004/0231338 | A1 | 11/2004 | Saito et al. | |
| 2004/0250550 | A1 * | 12/2004 | Bruck et al. | 62/3.1 |
| 2005/0000230 | A1 | 1/2005 | Saito et al. | |
| 2005/0097523 | A1 | 5/2005 | Uchida | |
| 2006/0076084 | A1 | 4/2006 | Nakajima | |

FOREIGN PATENT DOCUMENTS

| | | | |
|---|---|---|---|
| DE | 10338467 | | 3/2004 |
| EP | 1 463 068 | A2 | 9/2004 |
| JP | 2002-356748 | | 12/2002 |
| JP | 2003-96547 | | 4/2003 |
| JP | 2004-99928 | | 4/2004 |
| JP | 2004-100043 | | 4/2004 |

(Continued)

OTHER PUBLICATIONS

X. X. Zhang, et al. "Magnetic entropy change in Fe-based compound $LaFe_{10.6}Si_{2.4}$", Applied Physics Letters, American Institute of Physics, vol. 77, No. 19, Nov. 6, 2000, pp. 3072-3074.

A. Yan, et al., "Structure and magnetic entropy change of melt-spun $LaFe_{11.57}Si_{1.43}$ ribbons", Journal of Applied Physics 97, American Institute of Physics, 036102, 2005, 3 pages.

O. Gutfleisch, et al., "Large magnetocaloric effect in melt-spun $LaFe_{13-x}Si_x$", Journal of Applied Physics 97, American Institute of Physics, 10M305, 2005, 3 pages.

(Continued)

*Primary Examiner* — John P Sheehan

(74) *Attorney, Agent, or Firm* — Oblon, Spivak, McClelland, Maier & Neustadt, L.L.P.

(57) ABSTRACT

A magnetic material comprising a $NaZn_{13}$ type crystal structure with uniform and fine microstructure exhibiting excellent characteristics as a magnetic refrigeration material, and a method of manufacturing the magnetic refrigeration material are provided. An alloy composition for forming magnetic material of the $NaZn_{13}$ type crystal structure was melted comprising 0.5 atomic percent to 1.5 atomic percent of B to molten metal. The molten metal is rapidly cooled and solidified by a forced cooling process. Then, a rapidly cooled alloy having the $NaZn_{13}$ type crystal structure was obtained. In this manner, magnetic materials comprising the $NaZn_{13}$ type crystal structure phase, or the $NaZn_{13}$ type crystal structure phase accompanied with other phases such as α-Fe phase having very small phase regions was manufactured without requiring heat treatment for a long time. As the result, productivity of manufacturing the magnetic refrigeration material is remarkably enhanced.

20 Claims, 5 Drawing Sheets

FOREIGN PATENT DOCUMENTS

| | | | |
|---|---|---|---|
| JP | 2005-15911 | | 1/2005 |
| JP | 2005-036302 | | 2/2005 |
| JP | 2005-113270 | | 4/2005 |
| JP | 2005-141410 | | 6/2005 |
| JP | 2005-340838 | | 12/2005 |
| WO | WO 2004/038055 | A1 | 5/2004 |
| WO | WO 2004/068512 | * | 8/2004 |

OTHER PUBLICATIONS

U.S. Appl. No. 11/858,450, filed Sep. 20, 2007, Saito, et al.
U.S. Appl. No. 11/385,726, filed Mar. 22, 2006, Kobayashi, et al.
U.S. Appl. No. 11/675,839, filed Feb. 16, 2007, Kobayashi, et al.
U.S. Appl. No. 11/414,302, filed May 1, 2006, Tsuji, et al.
U.S. Appl. No. 12/015,812, filed Jan. 17, 2008, Tsuji, et al.

* cited by examiner

MAGNETIC REFRIGERATION MATERIAL AND METHOD OF MANUFACTURING THEREOF

CROSS-REFERENCE TO THE INVENTION

This application is based upon and claims the benefit of priority from the prior Japanese Patent Application No. 2005-085542, filed on Mar. 24, 2005 and the entire contents of which are incorporated herein by reference.

BACKGROUND OF THE INVENTION

1. Field of the Invention

The present invention relates to magnetic refrigeration materials and method of manufacturing them, and particularly to magnetic refrigeration materials excellent in magnetic refrigeration characteristics and a method of manufacturing the magnetic refrigeration materials capable of manufacturing the magnetic refrigeration materials with high productivity.

2. Description of the Related Art

In recent years, clean magnetic refrigeration with high energy efficiency ratio is anticipated increasingly as a technology for realizing environment protection type high efficiency refrigeration. Meeting to the requirement as the magnetic refrigeration, magnetic materials exhibiting a large magnetic entropy change at temperature ranges around room temperature have been found out.

Until now, (Hf, Ta)$Fe_2$, (Ti, Sc)$Fe_2$, (Nb, Mo)$Fe_2$, and La(Fe, Si)$_{13}$ having $NaZn_{13}$ type crystal structure have been proposed as magnetic materials for the magnetic refrigeration.

Among these magnetic refrigeration materials, materials having $NaZn_{13}$ type crystal structure and La (Fe, Si)$_{13}$ type chemical formula have attracted attention. In these materials, Fe mainly occupies the position corresponding to Zn, and La or the like mainly occupies the position corresponding to Na of $NaZn_{13}$ type crystal structure (after here, these materials are abbreviated as an $LaFe_{13}$ type magnetic material). These materials having Fe as the main constituent, show promising properties as practical magnetic refrigeration materials providing large magnetic entropy change, and moreover, exhibiting no temperature hysteresis in magnetic phase transition (see, for example, Japanese Patent Laid-open Application No. 2002-356748, Japanese Patent Laid-open Application No. 2003-96547).

There is a report of a method for manufacturing $LaFe_{13}$ type magnetic material (see X. X. Zhang et al., Appl. Phy. Lett., Vol. 77, No. 19 (2000)). According to the method, $LaFe_{13}$ type magnetic materials having a phase of $NaZn_{13}$ type crystal structure (hereinafter, abbreviated as a $NaZn_{13}$ type crystal structure phase) as the main phase were obtained initially making an unified raw material alloy by melting raw materials using an arc melting method, and then heat-treating the unified alloy at 1000° C. for a long heat-treating time of one month.

At the unifying step of unifying law metals using the arc, high frequency melting method or the like in this process of manufacturing the $LaFe_{13}$ type magnetic material, the unified alloy contains a large fraction of bcc crystal structure phase comprising Fe as the main constituent (after here, abbreviated as a α-Fe phase), and yield of the $NaZn_{13}$ type crystal structure phase is hardly seen in the unified alloy. For yielding the $LaFe_{13}$ type magnetic material from the unified alloy, therefore, the heat treatment for a long time at a high temperature is needed as described above.

Recently, two patent documents, Japanese Patent Laid-open Application No. 2004-100043 and Japanese Patent Laid-open Application No. 2004-99928 concerned with magnetic alloys having the $NaZn_{13}$ type crystal structure phase containing Fe as the main constituent and their manufacturing methods were published. The first patent document Japanese Patent Laid-open Application No. 2004-100043 discloses a method for producing magnetic alloys controlling formation of stable α-Fe phase and increasing yield of the $NaZn_{13}$ type crystal structure phase by cooling and solidifying a molten alloy succeeded using a single roll method instead of a conventional self cooling and solidifying method. The intended magnetic alloys were obtained by heat-treating the solidified alloys. The document discloses that this method shortens the time for heat treatment.

In the rapidly cooled alloy obtained using this method, however, the α-Fe phase remains as the main phase. Therefore, heat treatment is indispensable for obtaining an alloy comprising the $NaZn_{13}$ type crystal structure phase as the main phase. In addition, when the alloy is milled for use as particulate type magnetic refrigeration material, there arises a problem of notable decrease in composition uniformity among the material particles due to existing large amount of α-Fe phase material. Then, there occur particles consisting almost of α-Fe phase, other than the particles composed of $NaZn_{13}$ type crystal structure phase. Furthermore, with increasing fraction of the α-Fe phase, there happens a problem of increasing difficulty in milling.

It is generally known that cooling speed of a molten metal is about $1\times10^{2\circ}$ C./second in a conventional cooling after melting by a typical method of high-frequency melting or arc melting or the like, and the cooling speed of the molten metal increases up to $1\times10^{4\circ}$ C./second or higher by using a typical rapid liquid cooling method represented by a single roll cooling apparatus. In this specification and claims, cooling at a speed of $1\times10^{4\circ}$ C./second or higher is expressed as forced cooling.

The second patent document Japanese Patent Laid-open Application No. 2004-99928 discloses yield of the $NaZn_{13}$ type crystal structure phase immediately after casting obtained by comprising 1.8 to 5.4 atomic percent of boron B or the like in the raw material composition. The document further discloses that heat treatment for obtaining the $NaZn_{13}$ type crystal structure phase is facilitated by comprising B or the like. For the alloys comprising B or the like obtained by casting this method, however, there happens another problem of forming compounds containing B or the like.

Furthermore, A. Yan et al J. Appl. Phys. 97, 036102 (2005) reports structure and magnetic properties of La(Fe, Si)$_{13}$ prepared by a melt-spinning method. O. Gutfleisch et al J. Appl. Phys. 97, 10M305 (2005) reports a study on large magnetocaloric effect of La (Fe, Si)$_{13}$ material prepared by a melt-spinning method. Japanese Patent Laid-open Application No. 2005-15911 discloses an invention of material strength enhancement by introducing a phase that structurally reinforces the $NaZn_{13}$ crystal structure phase of a magnetic refrigeration material. Further, Japanese Patent Application No. 2005-141410 proposes a new production process of a magnetic refrigeration material comprising the $NaZn_{13}$ type crystal structure phase.

SUMMARY OF THE INVENTION

As described above, there has-been a problem of low productivity in manufacturing $LaFe_{13}$ type magnetic materials useful as magnetic refrigeration materials because a large fraction of α-Fe phase is formed and it takes a long heat treatment time for yielding the $NaZn_{13}$ type crystal structure phase from the α-Fe phase. The purpose of the present invention is to solve the problem and to provide a $LaFe_{13}$ type magnetic materials comprising large fraction of $NaZn_{13}$ type crystal structure phase and providing excellent characteristics as magnetic refrigeration materials, and also to provide a method of manufacturing magnetic refrigeration materials with high productivity, not requiring a long heat treatment time for obtaining an $NaZn_{13}$ type crystal structure phase by controlling α-Fe phase formation and by making the metal alloy microstructure smaller.

A magnetic refrigeration material of an embodiment of the present invention comprises a chemical composition including at least one element selected from the group consisting of Y, La, Ce, Pr, Nd, Sm, Eu, Gd, Tb, Dy, Ho, Er, Tm and Yb, at least one element selected from the group consisting of Fe, Co, Ni, Mn and Cr, at least one element selected from the group consisting of Si, C, Ge, Al, Ga and In, and 0.5 atomic percent to 1.5 atomic percent of B, and the magnetic refrigeration material comprises material phases including $NaZn_{13}$ type crystal structure phase and an α-Fe phase (bcc crystal structure phase having Fe as the main constituent), and the size of the α-Fe phase regions is not more than 20 μm.

The magnetic refrigeration material of an embodiment of the present invention is preferable to be a $LaFe_{13}$ type magnetic material comprising $NaZn_{13}$ type crystal structure phase regions and α-Fe phase regions having the α-Fe phase region size of not more than 20 μm, and to comprise at least one element selected from the group consisting of Y, La, Ce, Pr, Nd, Sm, Eu, Gd, Tb, Dy, Ho, Er, Tm and Yb in a total of 4 to 15 atomic percent, at least one element selected from the group consisting of Fe, Co, Ni, Mn and Cr in a total of 60 to 93 atomic percent, at least one element selected from the group consisting of Si, C, Ge, Al, Ga and In in a total of 2.5 to 23.5 atomic percent, and B of 0.5 to 1.5 atomic percent.

A method of manufacturing a magnetic refrigeration material of an embodiment of the present invention comprises a melting process melting a raw material composition comprising at least one element selected from a group consisting of Y, La, Ce, Pr, Nd, Sm, Eu, Gd, Tb, Dy, Ho, Er, Tm and Yb, at least one element selected from a group consisting of Fe, Co, Ni, Mn and Cr, at least one element selected from a group consisting of Si, C, Ge, Al, Ga and In, and 0.5 to 1.5 atomic percent of B, and a forced cooling process forcefully cooling and solidifying the molten metal and obtaining a rapidly cooled alloy comprising an $NaZn_{13}$ type crystal structure phase.

In the method of manufacturing the magnetic refrigeration material of an embodiment of the present invention, the magnetic refrigeration material is preferable to comprise at least one element selected from the group consisting of Y, La, Ce, Pr, Nd, Sm, Eu, Gd, Tb, Dy, Ho, Er, Tm and Yb in a total of 4 to 15 atomic percent, at least one element selected from the group consisting of Fe, Co, Ni, Mn and Cr in a total of 60 atomic percent to 93 atomic percent, at least one element selected from the group consisting of Si, C, Ge, Al, Ga and In in a total of 2.5 to 23.5 atomic percent, and B of 0.5 to 1.5 atomic percent.

Based on an embodiment of the present invention, manufacturing of $LaFe_{13}$ type magnetic material having the $NaZn_{13}$ type crystal structure phase is achieved controlling formation of α-Fe phase regions and the size of the α-Fe phase regions to extremely small size, by melting the raw material composition described above comprising 0.5 atomic percent to 1.5 atomic percent including B in the raw material composition, and by rapidly cooling the molten metal artificially. The alloy manufactured using the forced cooling and solidification process based on the embodiment of the present invention shows uniform microstructure comprising the $LaFe_{13}$ type magnetic material regions formed all over the alloy and other phase regions such as α-Fe phase regions with reduced sizes. By heat-treating the alloy, further increased microstructure uniformity and further increased characteristics as the magnetic refrigeration material is obtained in a short heat-treating time. The $LaFe_{13}$ type magnetic material having uniform microstructure accompanied with very small α-Fe phase regions at very small fraction is suitable for magnetic refrigeration material providing a large magnetic entropy change by applying a magnetic field. According to embodiments of present invention, manufacturing of $LaFe_{13}$ type magnetic materials with high productivity is realized.

DESCRIPTION OF THE EMBODIMENTS

Figure 1:
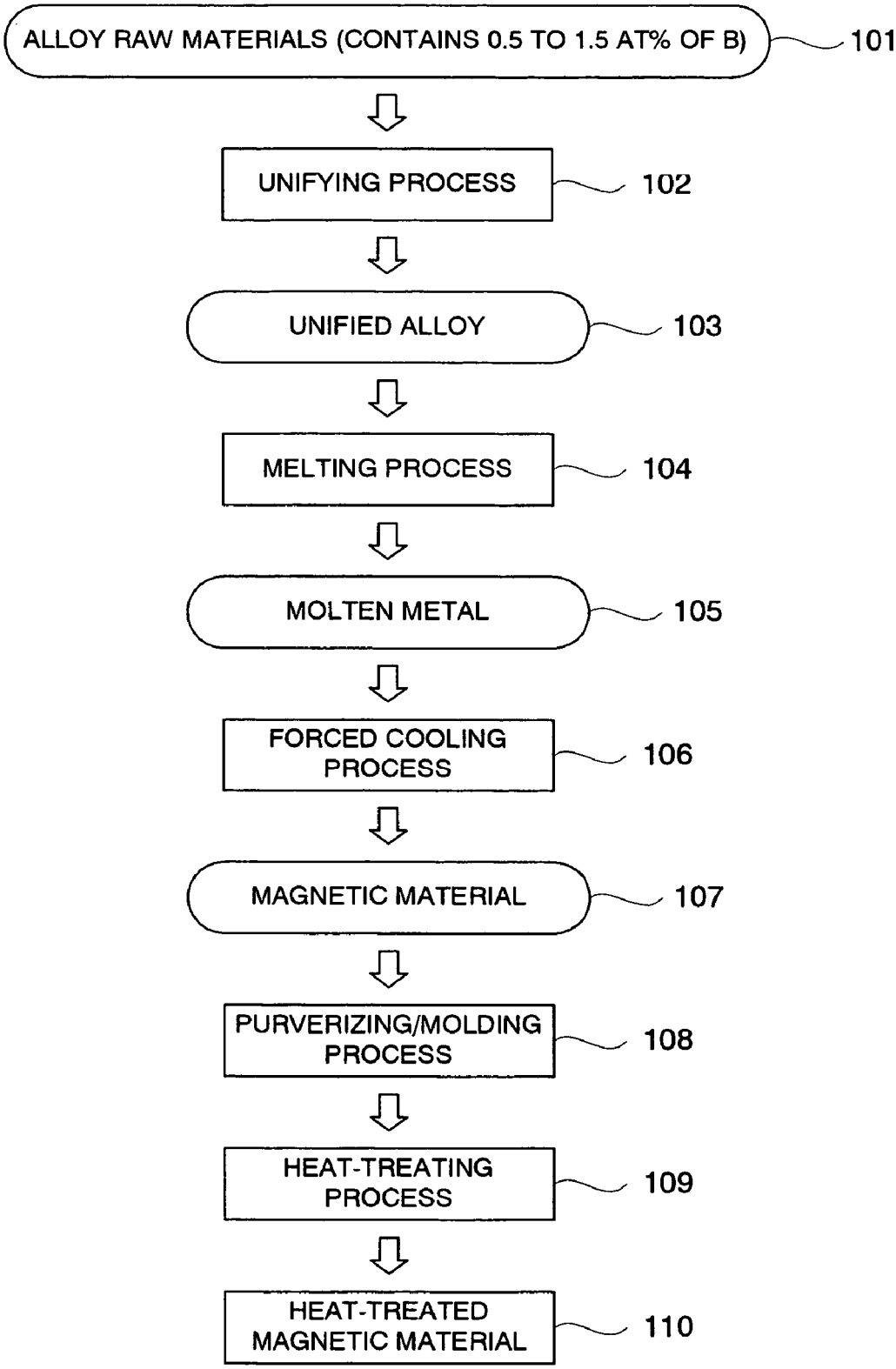
FIG. 1 is a flow chart showing an example of a manufacturing process according to an embodiment of the method of manufacturing magnetic material of the present invention.

FIG. 1 is a flow chart showing an example of a manufacturing process according to an embodiment of the method of manufacturing the $LaFe_{13}$ type magnetic material of the present invention. In FIG. 1, alloy raw materials 101 comprising 0.5 atomic percent to 1.5 atomic percent of B are melted in a unifying process 102 for forming a unified alloy 103. The unified alloy 103 is melted again in a melting process 104 and then a molten metal 105 is obtained. The molten metal 105 is rapidly cooled in a forced cooling process 106, and then, a magnetic material 107 having a $NaZn_{13}$ type crystal structure phase is obtained. The magnetic material 107 can be pulverized into small particles, molded in a pulverizing/molding process 108, and heat-treated in a heat-treating process 109. Then, a heat-treated magnetic material 110 comprising more the $NaZn_{13}$ type crystal structure phase regions is obtained.

For attaining uniformity of the molten metal 105 at the melting process 104, this flow chart shows an example of using the unified alloy 103 obtained after melting the alloy raw materials 101 once at the unifying process 102 by using a melting method such as arc melting or high frequency melting. Although the example of using the unified alloy 103 is shown as a suitable raw material alloy for obtaining the molten metal 105 with ensured uniformity in the forced cooling process 106, the raw material alloy for obtaining the molten metal 105 is not limited to the unified alloy as long as uniformity of the molten metal 105 is ensured. Therefore, the unifying process 102 and the unified alloy 103 in the flow chart can be omitted for the case.

The magnetic material 107 obtained in the forced cooling process 106 shown in this flow chart is applicable as a magnetic material for magnetic refrigeration, magnetostrictiive application and so on when the magnetic material comprises sufficient fraction of the $NaZn_{13}$ type crystal structure phase at the step after forced cooling.

The magnetic material yielding more fraction of the $NaZn_{13}$ type crystal structure phase applying the heat-treating process 109 can also be applicable. The magnetic material yielding more fraction of the $NaZn_{13}$ type crystal structure phase can also be obtained by pulverizing the magnetic material 107 obtained by the forced cooling process 106, molding into a desired shape at the pulverizing/molding process 108, and heat-treating the molded magnetic material. The heat-treated magnetic material is also used as a magnetic refrigeration material.

The heat-treating process 109 in an embodiment of the present invention is preferably performed in a temperature range between 900° C. and 1100° C. for example. The effect of heat treatment in the embodiment is obtained in a short heat-treating time of 150 hours or less, and the effect is also obtained even in a heat-treating time of 100 hours or less.

In the method of manufacturing the magnetic material of an embodiment of the present invention, the composition comprising at least an element selected from the group consisting of Y, La, Ce, Pr, Nd, Sm, Eu, Gd, Tb, Dy, Ho, Er, Tm and Yb in a total of 4 to 15 atomic percent, at least an element selected from the group consisting of Fe, Co, Ni, Mn and Cr in a total of 60 to 93 atomic percent, at least an element selected from the group consisting of Si, C, Ge, Al, Ga and In in a total of 2.5 to 23.5 atomic percent, and B in 0.5 to 1.5 atomic percent is applied as the composition of the above described alloy raw material 101.

Applying the process described above, the $LaFe_{13}$ type magnetic material of an embodiment of the present invention comprising the $NaZn_{13}$ type crystal structure phase is obtained controlling the size of the α-Fe phase regions to 20 μm or less, and controlling also region sizes of single phase or multiple phases formed accompanied with the α-Fe phase other than the $NaZn_{13}$ type crystal structure phase and the α-Fe phase (hereinafter, abbreviated as the third phase) appearing to small values.

The magnetic material of an embodiment of the present invention obtained above is a $LaFe_{13}$ type magnetic material comprising the $NaZn_{13}$ type crystal structure phase and the size of the α-Fe phase regions comprised in the magnetic material is very small and not more than 20 μm. Therefore, a sufficient heat treatment effect on the magnetic material is obtained in a short time as described above.

The $LaFe_{13}$ type magnetic materials providing very large magnetic entropy changes suitable as the magnetic refrigeration materials are obtained applying the above raw material compositions of an embodiment of the present invention comprising 5 to 10 atomic percent of La, 70 to 91 atomic percent of Fe, 3.5 to 18.5 atomic percent of Si, and 0.5 to 1.5 atomic percent of B. Larger magnetic entropy changes are obtained especially by preferably comprising 80 atomic percent or more of Fe. Larger magnetic entropy changes are obtained also by preferably comprising Co.

When the content of B does not reach 0.5 atomic percent with respect to the present invention, the size of the α-Fe phase regions tends not to be small enough, even if the cooling speed of the molten metal in the forced cooling process is enhanced. When the content of B does not reach 0.3 atomic percent, the α-Fe phase becomes coarse, and when it does not reach 0.1 atomic percent, the α-Fe phase becomes much coarser. On the other hand, when the content of B exceeds 1.5 atomic percent, the B forms compounds with other constituent elements, and the size of the third phase regions becomes larger with increasing the amount of B. Especially when the material contains La, Fe or Si, these elements form stable eutectoids with B, the third phase regions comprising compounds such as BFe, $BFe_2$, $B_6Si$, $BS_1$, $B_6La$, or $B_4La$ and the α-Fe phase are easily formed. The increase in the sizes of the third phase regions and the α-Fe regions becomes a cause for preventing the yield of the $NaZn_{13}$ type crystal structure phase. In this invention, the third phase is always formed when the α-Fe phase is formed. When La, Fe and Si are used as the law materials of an embodiment of the present invention, the third phase comprising $La_5Si_3$, LaSi, $LaSi_2$, $Fe_2Si$, $Fe_5Si_3$, $FeSi_2$, $Fe_3Si$, $FeSi_2$, FeSi or LaFeSi can be formed.

For this reason, the content of B is preferable to be 0.5 atomic percent or more and more preferably 0.8 atomic percent or more. On the other hand, the content of B is preferable to be 1.5 atomic percent or less, and more preferably, 1.2 atomic percent or less.

When the content of Fe is less than 78 atomic percent, yield of the $NaZn_{13}$ type crystal structure phase is obtained without forced cooling after applying high frequency melting or arc melting. Without forced cooling, however, yield of the $NaZn_{13}$ type crystal structure phase decreases gradually with increasing the Fe content. Especially when molten alloy comprising 78 atomic percent or more of Fe is cooled without using forced cooling, the yield of the $NaZn_{13}$ type crystal structure phase does not occur but coarse α-Fe phase regions appears. With increasing the Fe content, yield of the $NaZn_{13}$ type crystal structure phase tends to be prevented and many α-Fe phase regions tend to appear.

Since a large magnetic entropy change is obtained when the Fe content in the $NaZn_{13}$ type crystal structure phase is as much as 78 atomic percent or more for example, the beneficial effect of an embodiment of the present invention is especially remarkable for manufacturing the magnetic refrigeration material providing large magnetic entropy change. Therefore, the present invention is especially suitable for manufacturing the $LaFe_{13}$ type magnetic material providing a large magnetic entropy change.

In alloy compositions comprising La and Fe as the constituent elements, a factor for preventing yield of the $NaZn_{13}$ type crystal structure phase is in the fact that no solid solution is formed between La and Fe. When the Fe content is 78 atomic percent or more, the preventing effect is notable and coarse α-Fe phase regions tend to appear. By comprising 0.5 to 1.5 atomic percent of B according to an embodiment of the present invention, yield of the $NaZn_{13}$ type crystal structure phase is obtained effectively, suppressing the appearance of the coarse α-Fe phase regions, even if the composition comprises La and Fe. Furthermore, the effect of suppressing the coarse α-Fe phase regions is found also by comprising Co. The effect is found by comprising 0.5 atomic percent or more. The content of 15 atomic percent or less of Co is sufficient for suppressing the appearance of the α-Fe phase.

The forced cooling in the method of manufacturing a magnetic material of an embodiment of the present invention is to cool rapidly acting a heat absorbing material artificially to a molten metal. To achieve the forced cooling, the method for rapidly cooling molten metal is not especially limited. Methods of water atomizing, gas atomizing, centrifugal atomizing, and plasma atomizing are available, and further, a rotational electrode method, a RDP method, a single roll rapid cooling method, a twin roll rapid cooling method, and a strip casting method are also available for this purpose.

By choosing the single roll rapid cooling method or the twin roll rapid cooling method from these methods, we can take an advantage of performing high-speed forced cooling under a well-controlled cooling condition by choosing parameters of the discharging rate of the molten metal, the circumferential speed of the roll and so on. A cooling speed of $1\times10^{4}$° C./second or more is attained by decreasing the thickness of the ribbon obtained by this method to 100 μm or less. Magnetic material in a shape of fine particles suitable for the magnetic refrigeration material for example, is obtained directly by using the water atomizing method, the gas atomizing method, the centrifugal atomizing method, the plasma atomizing method, the rotational electrode method or the RDP method. In these methods, higher cooling speed is obtained by decreasing the particle sizes to smaller values. In these methods, higher cooling effect is obtained when the particle size is smaller and the ribbon thickness is thinner. The forced cooling for forming ribbon is preferable to be performed so that the thickness of the ribbons are 50 μm or less and more preferably, so that the thickness of the ribbons are 30 μm or less, and the forced cooling by particle shape is preferable to be performed so that the size of the particles are 2 mm or less, more preferably so that the size of the particles are 1.5 mm or less, and further more preferably so that the particles are 1 mm or less, since higher cooling effect is obtained by decreasing the ribbon thickness or the particle size to smaller values.

At the forced cooling process 108, the cooling speed of artificially cooling the molten metal obtained by melting an alloy is preferably from $1\times10^{4}$° C./second to $1\times10^{8}$° C./second in the present invention.

When the molten metal is solidified at a low cooling speed of less than $1\times10^{2}$° C./second in contrast to the present invention, sufficient yield of the $NaZn_{13}$ type crystal structure phase is prevented because the α-Fe phase appears prior to the other phases. When the cooling speed is $1\times10^{4}$° C./second or more on the other hand, yield of the $NaZn_{13}$ type crystal structure phase is more stable since appearance of the α-Fe phase is suppressed as a result of very small size metal microstructure formation. This advantageous effect is also obtained in a method realizing extremely high cooling speed such as a vapor explosion method, for example. The suitable cooling speed is from $1\times10^{4}$° C./second to $1\times10^{8}$° C./second and the sufficient advantageous effect is obtained at the cooling speed of not higher than $1\times10^{8}$° C./second. Although the effect is kept of course at higher cooling speed, technically difficult higher cooling speed over $1\times10^{8}$° C./second is not essentially necessary here.

In the present invention, formation of the α-Fe phase is suppressed more and preferential yield of the $NaZn_{13}$ type crystal structure phase increases more with increasing cooling speed. For this reason, more preferable cooling speed in the present invention is $1\times10^{5}$° C./second or higher.

In this way, the magnetic material comprising the $NaZn_{13}$ type crystal structure phase with small sized α-Fe phase regions of not more than 20 μm is obtained by rapidly cooling the molten metal containing the adjusted quantity of B in the alloy composition. The size of the α-Fe phase in the magnetic material is preferable to reduce to values not more than 10 μm, and is more preferable to reduce to values not more than 6 μm for further increasing the uniformity of the magnetic material.

In the $LaFe_{13}$ type magnetic material of an embodiment of the present invention manufactured by the procedure described above, the positions corresponding to Na atoms of the $NaZn_{13}$ type crystal structure phase are occupied mainly by atoms of at least one element selected from the group consisting of Y, La, Ce, Pr, Nd, Sm, Eu, Gd, Tb, Dy, Ho, Er, Tm and Yb, and the positions corresponding to Zn atoms of the $NaZn_{13}$ type crystal structure phase are mainly occupied by atoms of at least one element selected from the group consisting of Fe, Co, Ni, Mn, and Cr, and at least one element selected from the group consisting of Si, C, Ge, Al, Ga and In.

When much oxygen is contained in the magnetic material of an embodiment of the present invention, oxides having high melting temperature are formed as impurities, and the oxides interrupt yield of the magnetic material having good material quality. For avoiding formation of the oxides, therefore, alloys with small oxygen content are found to be desirable.

To attain compositions with no oxygen at all, namely to make the content of oxygen zero atomic percent is difficult and is practically not necessary. Then, we have found that suppressing the oxygen content of the alloy to 2 atomic percent or less is desirable, and suppressing the oxygen content of the alloy to 0.2 atomic percent or less is further desirable.

EXAMPLE 1 AND COMPARATIVE EXAMPLES 1-7

Example 1 and Comparative Examples 1 to 7 of the $LaFe_{13}$ type magnetic material produced based on the present invention is described.

Figure 6:
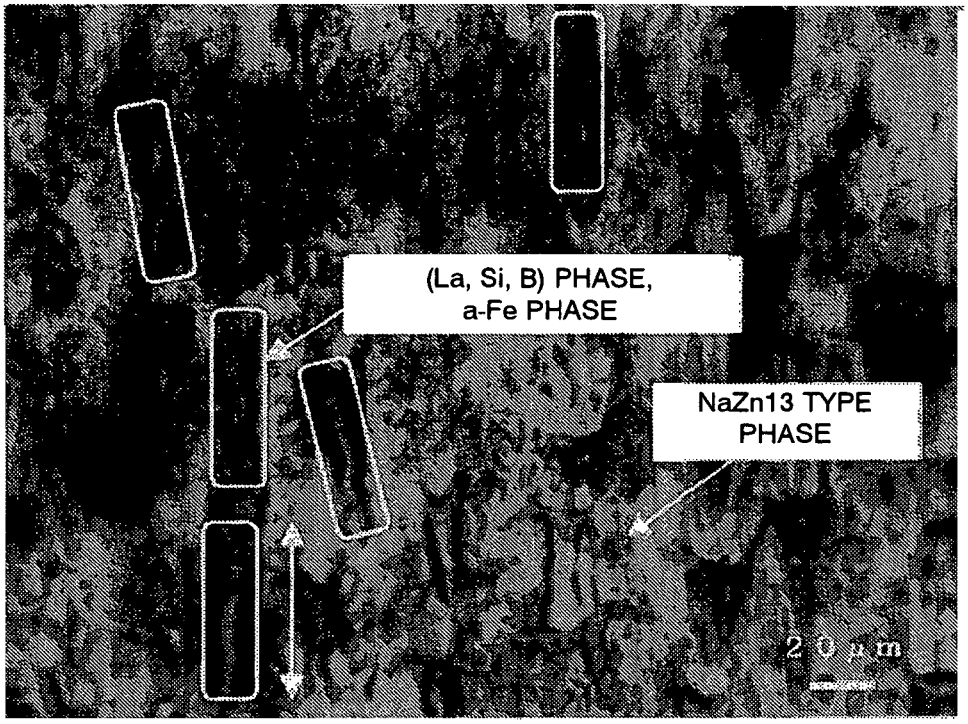
FIG. 6 is an optical microscope photograph showing a cross section microstructure of sample 5 as a comparative example (Comparative Example 5) with respect to the present invention.
Figure 7:
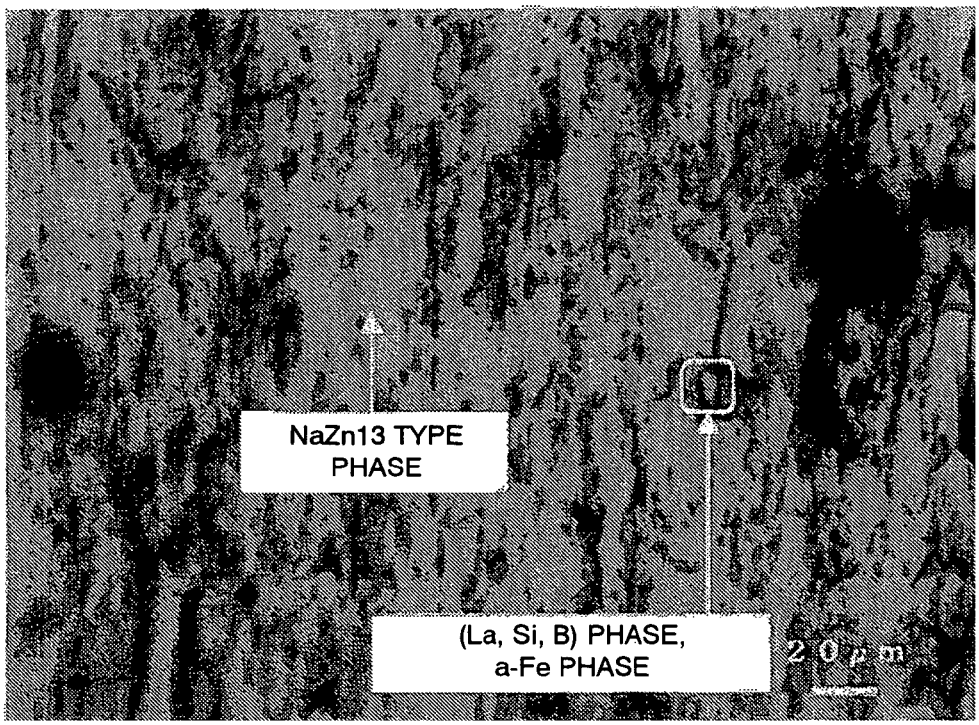
FIG. 7 is an optical microscope photograph showing cross section microstructure of sample 6 as an example (Example 1) according to an embodiment of the present invention.
Figure 8:
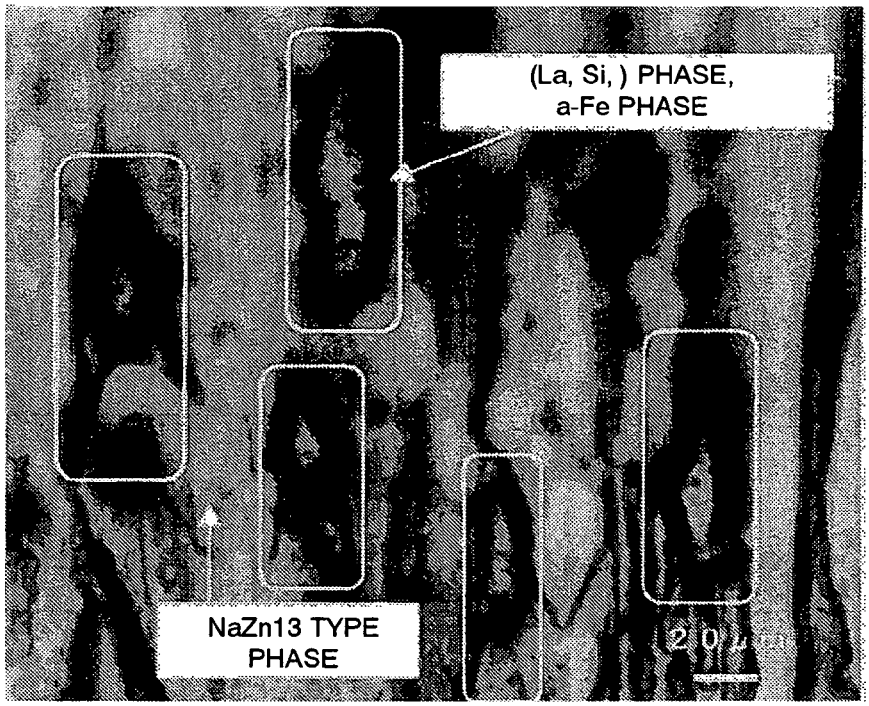
FIG. 8 is an optical microscope photograph showing a cross section microstructure of sample 7 as a comparative example (Comparative Example 6) with respect to the present invention.

First of all, each alloy composition for samples 1 to 3 shown in Table 1 was melted using the arc melting method, and solidified by cooling on a water cooled Cu hearth (cooling speed of lower than $1\times10^{2}$° C./second), and then sample 1-3 were obtained as a comparative examples (Comparative Examples 1-3) to the present invention. The cross section microstructure of these samples was investigated by optical microscope observation in detail. Further, the crystal structure analysis of these samples was performed using the powder X-ray diffraction method. The main reflection line intensity ratio I of the $LaFe_{13}$ type phase having the $NaZn_{13}$ type crystal structure of each sample was evaluated and compared each other. At the evaluation, the main reflection line intensity ratio I of the $LaFe_{13}$ type phase was defined as $I=(I_1/(I_1+I_2+I_3))\times100$ (percent), where $I_1$ is the main reflection line intensity of $NaZn_{13}$ type crystal structure phase, $I_2$ is the main reflection line intensity of the α-Fe phase, and $I_3$ is the largest main reflection line intensity of the third phase. Size of phase regions for each phase in this specification and claims is defined as the arithmetic average of the five long diameters for the five phase regions having the most largest to the fifth largest long diameter for each phase in a 200 μm square evaluation zone determined using the element mapping diagram of EPMA, the optical microscope and the reflection electron images, and the values were obtained. Here, the long diameters are defined as the long diameters of ellipsoids that approximate the phase regions. The words of size in the present specification and claims are defined by this description. The white frames in FIG. 6 to FIG. 8 show examples of the phase regions. In the compositions of these samples, La and Fe are set at 7.1 atomic percent and 80.8 atomic percent respectively, the total content of Si and B is set at 12.1 atomic percent, and the atomic percentage of B is varied. The phase determination in the optical microscope images was performed comparing the images with reflection electron images, EPMA results and X-ray diffraction patterns.

TABLE 1

| | Composition (atomic percent) | | | | | Structure observation | $LaFe_{13}$ type phase X-ray diffraction |
|---|---|---|---|---|---|---|---|
| | La | Fe | Si | B | Treatment | result | intensity (percent) |
| Sample 1 (Comparative Example 1) | 7.1 | 80.8 | 12.1 | | Alloying and unifying treatment by arc melting without forced cooling | α-Fe phase and the third phase. 1-13 phase is not seen | 0 |
| Sample 2 (Comparative Example 2) | 7.1 | 80.8 | 11.1 | 1.0 | Alloying and unifying treatment by arc melting without forced cooling | α-Fe phase and the third phase. 1-13 phase is not seen | 0 |
| Sample 3 (Comparative Example 3) | 7.1 | 80.8 | 8.4 | 3.7 | Alloying and unifying treatment by arc melting without forced cooling | α-Fe phase and the third phase. 1-13 phase is not seen | 0 |
| Sample 4 (Comparative Example 4) | 7.1 | 80.8 | 12.1 | 0 Without B | After alloyed and unified by high-frequency melting, forced cooling treatment | Fine 1-13 phase, coarse α-Fe phase and the third phase | 26 |
| Sample 5 (Comparative Example 5) | 7.1 | 80.8 | 11.8 | 0.3 B small | After alloyed and unified by high-frequency melting, forced cooling treatment | Fine 1-13 phase. α-Fe phase and the third phase of 25 to 50 μm | 34 |
| Sample 6 (Example 1) | 7.1 | 80.8 | 11.1 | 1.0 | After alloyed and unified by high-frequency melting, forced cooling treatment | Fine 1-13 phase. α-Fe phase and the third phase are not more than 5 μm | 65 |
| Sample 7 (Comparative Example 6) | 7.1 | 80.8 | 9.3 | 2.8 B large | After alloyed and unified by high-frequency melting, forced cooling treatment | Fine 1-13 phase, coarse α-Fe phase and the third phase | 24 |
| Sample 8 (Comparative Example 7) | 7.1 | 80.8 | 8.4 | 3.7 B large | After alloyed and unified by high-frequency melting, forced cooling treatment | Fine 1-13 phase, coarse α-Fe phase and the third phase | 19 |

Figure 2:
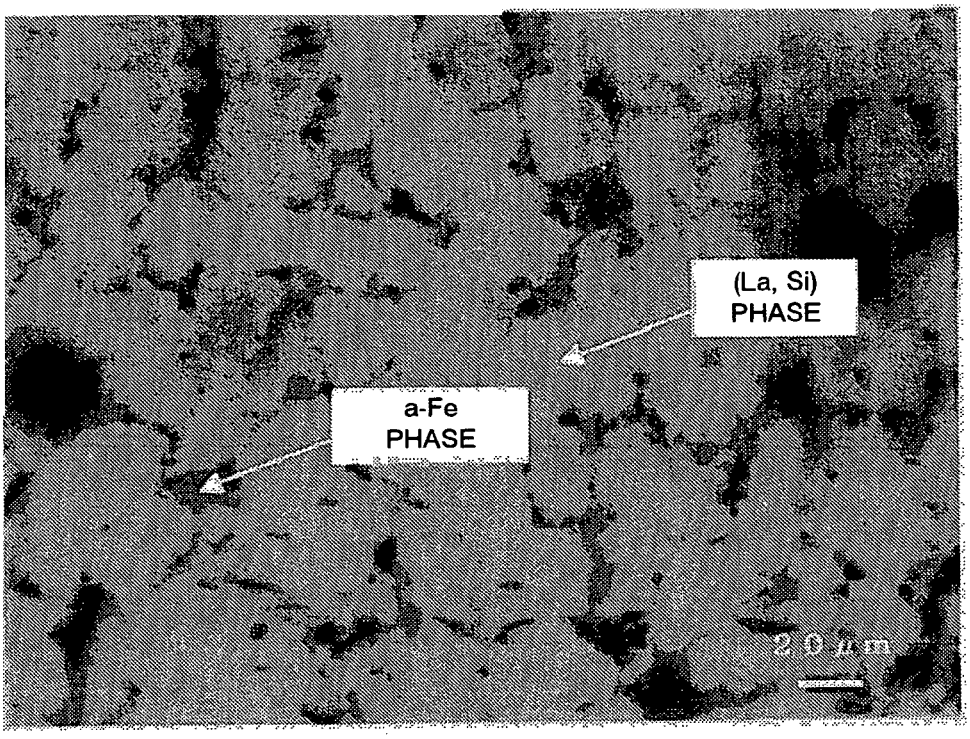
FIG. 2 is an optical microscope photograph showing cross section microstructure of sample 1 as a comparative example (Comparative Example 1) with respect to the present invention.
Figure 3:
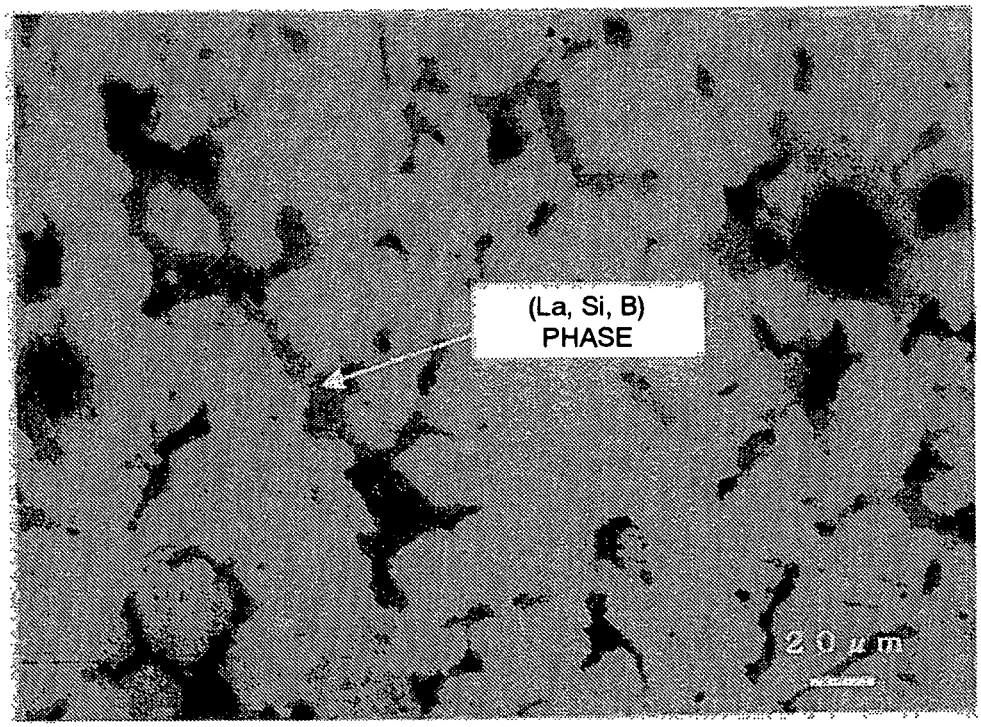
FIG. 3 is an optical microscope photograph showing cross section microstructure of sample 2 as a comparative example (Comparative Example 2) with respect to the present invention.
Figure 4:
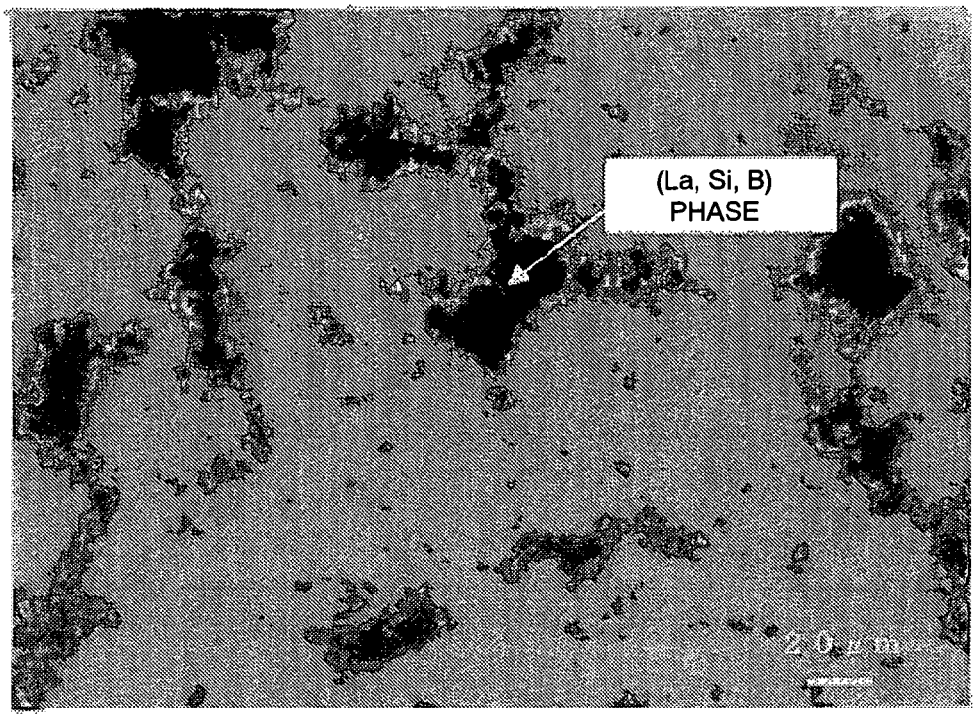
FIG. 4 is an optical microscope photograph showing cross section microstructure of sample 3 as a comparative example (Comparative Example 3) with respect to the present invention.

Optical microscope photographs for cross sections of the samples 1, 2 and 3 are shown in FIGS. 2, 3 and 4, respectively.

As seen in FIG. 2, yield of the $NaZn_{13}$ type crystal structure phase was not found in the sample 1, but two phases of the α-Fe phase and the third phase were seen. The size of the α-Fe phase region was 25 to 50 μm. Yield of the $LaFe_{13}$ type crystal structure phase was not found also in the X-ray diffraction pattern.

Yield of the $NaZn_{13}$ type crystal structure phase was not found also in the sample 2 as shown in FIG. 3, and the result was substantially the same as the sample 1. Similar to the case for sample 1, the two phases of the α-Fe phase and the third phase were seen for the sample 2, and the third phase was found to contain B. In the X-ray diffraction pattern, yield of the $LaFe_{13}$ type crystal structure phase was not found.

Yield of the $NaZn_{13}$ type crystal structure phase was not seen also in the sample 3, as shown in FIG. 4. The result was similar to the case for the sample 1 and 2. The α-Fe phase and the third phase were seen in this figure similar to the case for the sample 2. Yield of the $LaFe_{13}$ type crystal structure phase was not seen in the X-ray diffraction pattern of this sample, similar to the case for the sample 1 and 2

As described above, yield of the $NaZn_{13}$ type crystal structure phase was not found but the α-Fe phase and the third phase were seen for all these alloys obtained by melting the alloys of the above described respective compositions and solidifying at slow cooling speed below the speed of forced cooling.

In the alloy compositions of the sample 2 and 3, the composition of the third phase regions were replaced by mainly La, Si and B from La and Si of the sample 1 as a result of comprising B at quantities described above. For yielding the $NaZn_{13}$ type crystal structure phase, however, no remarkable improvement was seen.

The main points of structure observation results for the samples 1 to 3 using the optical microscope were summarized in Table 1 (In the table and the figures, the $NaZn_{13}$ type crystal structure phase is expressed simply by 1-13 phase). The heat treatment time of 250 hours or more was needed to yield the $NaZn_{13}$ type crystal structure phase by heat-treating these alloys.

The samples 4 to 8 shown in Table 1 were obtained as follows. Each unified alloy of the compositions shown in Table 1 for samples 4 to 8 was obtained using high-frequency melting method. Subsequently, each unified alloy was melted into molten alloy and cooled artificially at the cooling speed of about $3\times10^{5}$° C./second in vacuum using a single roll rapid cooling apparatus. Then, the samples 4 to 8 were obtained. The sample 6 is an example according to an embodiment of the present invention (Example 1), and the samples 4, 5, 7 and 8 are comparative examples to the example of the invention (Comparative Examples 4 to 7). The cross section microstructure of each sample was examined by optical microscope observation in detail. In the composition of these samples, La and Fe were fixed at 7.1 atomic percent and 80.8 atomic percent, respectively, total content of Si and B was set at 12.1 atomic percent, and the atomic percentage of B was varied.

Figure 5:
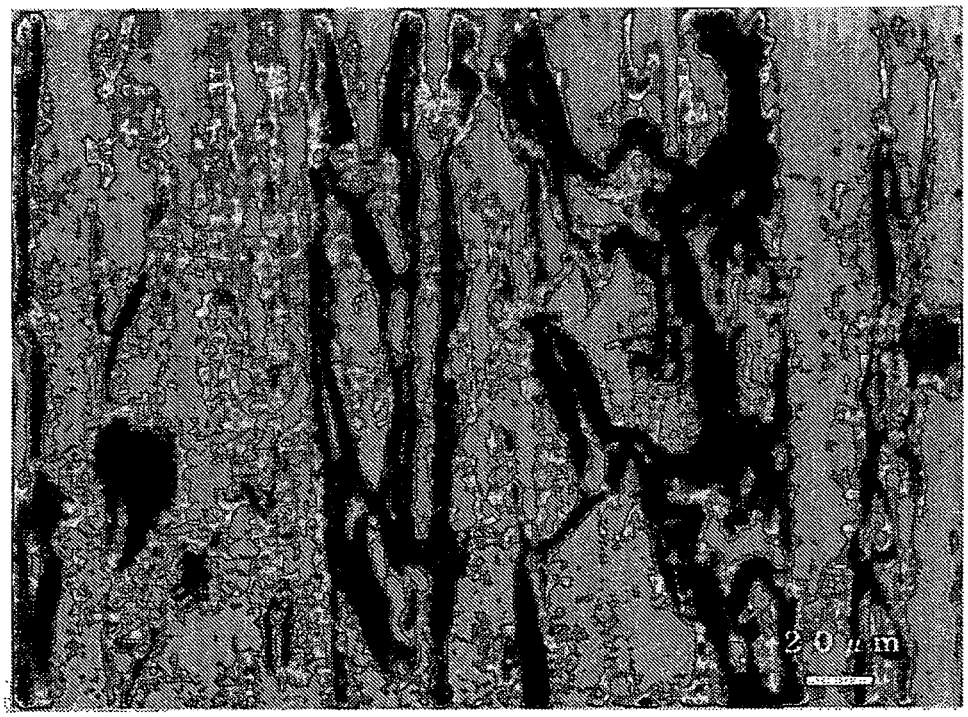
FIG. 5 is an optical microscope photograph showing cross section microstructure of sample 4 as a comparative example (Comparative Example 4) with respect to the present invention.

FIG. 5 shows an optical microscope photograph of sample 4 without containing B prepared as a comparative example (Comparative Example 4). As seen in FIG. 5, yield of extremely small $NaZn_{13}$ type crystal structure phase regions of 5 μm or less was found in the sample 4 solidified using the forced cooling process. However, the coarse third phase regions and α-Fe phase regions of 50 to 100 μm size were formed accompanied with the $NaZn_{13}$ type crystal structure phase regions. X-ray diffraction pattern of the sample confirmed formation of the third phase, the α-Fe phase and the $LaFe_{13}$ type crystal structure phase. The main reflection line intensity ratio of the $LaFe_{13}$ type crystal structure phase was 26 percent. Yield of the $NaZn_{13}$ type crystal structure phase was attained as an extremely small microstructure obtained by the forced cooling. However, long heat treatment time over 150 hours was still needed to yield the $NaZn_{13}$ type crystal structure phase sufficiently since the coarse third phase and the α-Fe phase were seen in the sample 4 alloy.

FIG. 6 shows an optical microscope photograph of sample 5 prepared by forced cooling of the alloy comprising 0.3 atomic percent of B. In the sample 5 prepared by the forced cooling of the molten metal comprising 0.3 atomic percent of B, yield of extremely small $NaZn_{13}$ type crystal structure phase regions was found as seen in FIG. 6. The third phase and the α-Fe phase were also formed in the alloy, and the diameters of these phase regions were found to be smaller sizes of about 25 to 50 μm. In this way, the alloy comprising very small $NaZn_{13}$ type crystal structure phase regions accompanied with the relatively small third phase and α-Fe phase regions was obtained when the molten metal contained 0.3 atomic percent of B, and the molten metal was rapidly cooled and solidified artificially. The X-ray diffraction pattern confirmed formation of the third phase, the α-Fe phase and the $LaFe_{13}$ type phase. The main reflection line intensity ratio of the $LaFe_{13}$ type crystal structure phase was 34 percent. The heat-treating time for yielding the $NaZn_{13}$ type crystal structure phase was reduced from this result, however, further improvement was needed.

FIG. 7 shows an optical microscope photograph of the sample 6 manufactured as an example of the present invention (Example 1). This sample was obtained by forced cooling of molten alloy comprising 1.0 atomic percent of B. As seen in FIG. 7, the alloy prepared by the forced cooling of the molten metal comprising 1.0 atomic percent of B was constructed mostly by small $NaZn_{13}$ type crystal structure phase regions accompanied with the small size third phase regions and α-Fe phase regions of not more than 5 μm. The X-ray diffraction pattern confirmed formation of the $NaZn_{13}$ type crystal structure phase, the third phase and the α-Fe phase. The main reflection line intensity ratio of the $NaZn_{13}$ type crystal structure phase was 65 percent. This alloy comprises the $NaZn_{13}$ type crystal structure phase as the main phase and exhibits a large magnetic entropy change. Therefore, this alloy is suitable as magnetic refrigeration material. Heat treating the alloy for a short time, yield of the $NaZn_{13}$ type crystal structure phase was further increased, and $LaFe_{13}$ type magnetic material providing a larger magnetic entropy change was obtained.

FIG. 8 shows an optical microscope photograph of sample 7 prepared as Comparative Example 6. Containing an increased B content of 2.8 atomic percent, the alloy prepared by forced cooling molten metal exhibited yield of the fine $NaZn_{13}$ type crystal structure phase, while formation of the coarse third phase and the α-Fe phase were also observed as shown in FIG. 8. The X-ray diffraction pattern confirmed formation of the third phase, the α-Fe phase and the $LaFe_{13}$ type phase, and the main reflection line intensity ratio of the $LaFe_{13}$ type crystal structure phase was 24 percent.

Figure 9:
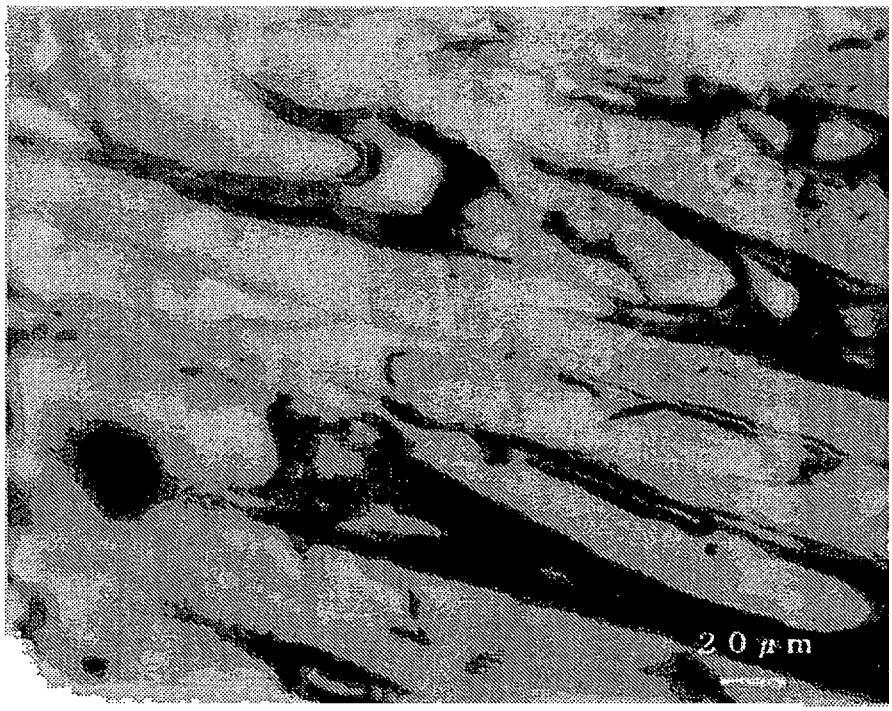
FIG. 9 is an optical microscope photograph showing cross section microstructure of sample 8 as a comparative example (Comparative Example 7) with respect to the present invention.

FIG. 9 shows an optical microscope photograph of the sample 8 prepared as Comparative Example 7. In the sample 8 prepared by solidifying the molten metal containing an enhanced B content of 3.7 atomic percent using the forced cooling process, formation of the coarse third phase and the α-Fe phase was observed, although the yield of the fine $NaZn_{13}$ type crystal structure phase was observed similar to the case for the sample 7 as shown in FIG. 9. The X-ray diffraction pattern confirmed formation of the third phase, the α-Fe phase and the $LaFe_{13}$ type crystal structure phase. The main reflection line intensity ratio of the $LaFe_{13}$ type crystal structure phase was 19 percent. Heat treatment time over 150 hours was needed for heat-treating the sample 7 and the sample 8.

The main points of the microstructure observation results obtained using the optical microscope for each alloy of samples 4 to 8 were summarized in Table 1 together with each composition and the preparation condition.

As a result of forced cooling and solidifying the molten metal comprising 0.5 atomic percent to 1.5 atomic percent of B in the alloy composition forming the $LaFe_{13}$ type crystal structure phase, the microstructure of the metal alloy was made small, suppressing formation of the third phase and making the size of the α-Fe phase regions extremely small from these results. These results shows that the yield of the $NaZn_{13}$ type crystal structure phase by atomic diffusion advances efficiently, and $LaFe_{13}$ type magnetic materials having more uniform structure and providing excellent in magnetic refrigeration characteristics superior to the prior art are manufactured with higher productivity.

EXAMPLES 2 TO 5

Samples 8 to 11 were manufactured choosing compositions neighboring to the composition of Example 1 exhibiting good results from the range including the Example and the Comparative Examples described above using the same manufacturing process conditions for Example 1 and Comparative Examples 4-5. Microstructure observation by an optical microscope and crystal structure analysis by the powder X-ray diffraction method were performed for these samples 8 to 11. The structure observation results and the main intensity ratios of the $LaFe_{13}$ type phases in the X-ray diffraction with the compositions and the process conditions are shown in Table 2.

TABLE 2

| | Composition (atomic percent) | | | | | Structure observation | 1-13 phase X-ray diffraction |
|---|---|---|---|---|---|---|---|
| | La | Fe | Si | B | Treatment | result | intensity (percent) |
| Sample 8 (Example 2) | 7.1 | 80.8 | 11.6 | 0.5 | After alloyed and unified by high-frequency melting, forced cooling treatment | Fine 1-13 phase, and α-Fe phase and the third phase of 10 to 20 μm | 52 |
| Sample 9 (Example 3) | 7.1 | 80.8 | 11.3 | 0.8 | After alloyed and unified by high-frequency melting, forced cooling treatment | Fine 1-13 phase, and α-Fe phase and the third phase of not more than 10 μm | 62 |
| Sample 10 (Example 4) | 7.1 | 80.8 | 10.9 | 1.2 | After alloyed and unified by high-frequency melting, forced cooling treatment | Fine 1-13 phase, and α-Fe phase and the third phase of not more than 10 μm | 66 |
| Sample 11 (Example 5) | 7.1 | 80.8 | 10.6 | 1.5 | After alloyed and unified by high-frequency melting, forced cooling treatment | Fine 1-13 phase, and α-Fe phase and the third phase of 10 to 20 μm | 55 |

From these results, these alloys comprising B in the range of 0.5 to 1.5 atomic percent were composed mainly of the fine $NaZn_{13}$ type crystal structure phases accompanied with the third phase and the α-Fe phase both having very small region sizes, and these alloys formed $LaFe_{13}$ type magnetic materials providing a large magnetic entropy change. By heat-treating these alloys for a short time, the alloys further yield the $NaZn_{13}$ type crystal structure phase and $LaFe_{13}$ type magnetic materials providing larger magnetic entropy changes were obtained.

The above-described examples are for compositions setting La and Fe at 7.1 and 80.8 atomic percent, respectively, Si and B at 12.1 in total, and varying atomic percent of B. Similar to the case for these examples, microstructure composed mostly of the fine $NaZn_{13}$ type crystal structure phase was also obtained for the metal alloys comprising 5 to 10 atomic percent of La, 70 to 91 atomic percent of Fe, and 3.5 to 18.5 atomic percent of Si, and 0.5 atomic percent to 1.5 atomic percent of B manufactured using the forced cooling process. The phase regions of the third phase and the α-Fe phase were very small and further yield of the $NaZn_{13}$ type crystal structure phase was obtained by heat-treating for a short time. Similar result was also obtained for alloy compositions comprising 0.5 percent to 15 percent of Co.

Furthermore, the alloys having the fine $NaZn_{13}$ type crystal structure phase as the main phase accompanied with the very small third phase and very small α-Fe phase were obtained by using forced cooling process for each of molten alloy for the compositions comprising at least one element selected from the group consisting of Y, La, Ce, Pr, Nd, Sm, Eu, Gd, Tb, Dy, Ho, Er, Tm and Yb in a total of 4 to 15 atomic percent, at least one element selected from the group consisting of Fe, Co, Ni, Mn and Cr in a total of 60 to 93 atomic percent, at least one element selected from the group consisting of Si, C, Ge, Al, Ga and In in a total of 2.5 to 23.5 atomic percent, and B of 0.5 atomic percent to 1.5 atomic percent. Furthermore, yield increase of the $NaZn_{13}$ type crystal structure phase in each alloy was obtained by a short time annealing. In this way, $LaFe_{13}$ type magnetic materials were obtained.

EXAMPLE 6

The sample 12 was fabricated by cooling at the forced cooling speed of $1\times10^{4\circ}$ C./second which was lower than $3\times10^{5\circ}$ C./second for Example 1. Optical microscope observation of the sample alloy cross section microstructure and powder X-ray diffraction crystal structure analysis were performed. The microstructure observation result and the main reflection line intensity ratio of the $LaFe_{13}$ type phase by X-ray analysis as well as the composition and treatment condition of the sample 12 are shown in Table 3.

TABLE 3

| | Composition (atomic percent) | | | | | Structure observation | 1-13 phase X-ray diffraction |
|---|---|---|---|---|---|---|---|
| | La | Fe | Si | B | Treatment | result | intensity (percent) |
| Sample 10 (Example 6) | 7.1 | 80.8 | 11.1 | 1.0 | After alloyed and unified, forced cooling at $1\times10^{4\circ}$ C./sec | Fine 1-13 phase, α-Fe phase and the third phase are not more than 20 μm | 50 |

As shown in Table 3, alloy microstructure of the fine $NaZn_{13}$ type crystal structure phase with controlled α-Fe phase regions and the third phase region sizes not more than 20 μm was obtained and the advantageous effect of an embodiment of the present invention was obtained even by the forced cooling treatment at the cooling speed of $1\times10^{4\circ}$ C./second.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A magnetic refrigeration material, comprising:

a chemical composition including at least one first element selected from the group consisting of Y, La, Ce, Pr, Nd, Sm , Eu, Gd, Tb, Dy, Ho, Er, Tm and Yb in a total of 4 to 15 atomic percent; at least one second element selected from members of the group consisting of Fe, Co, Ni, Mn and Cr in a total of 60 to 93 atomic percent; at least one third element selected from members of the group consisting of Si, C, Ge, Al, Ga and In in a total of 2.5 to 23.5 atomic percent; and B of 0.5 atomic percent to 1.5 atomic percent; and material phases including $NaZn_{13}$ type crystal structure phase not containing B; a bcc crystal structure phase comprising Fe as the main constituent element with phase region size of 20 μm or less; and a third phase containing the first element, the third element and B and not containing Fe, wherein the magnetic refrigeration material is obtained through a forced cooling process.

2. The magnetic refrigeration material according to claim 1, in which the chemical composition includes 5 to 15 atomic percent of La; 70 to 91 atomic percent of Fe; 3.5 to 18.5 atomic percent of Si; and 0.5 to 1.5 atomic percent of B, and the material phases include the $NaZn_{13}$ type crystal structure phase; and the bcc crystal structure phase comprising Fe as the main constituent element with phase region size of 20 μm or less.

3. The magnetic refrigeration material according to claim 1, in which the chemical composition includes 80 atomic percent or more of Fe.

4. The magnetic refrigeration material according to claim 1, in which the chemical composition includes 0.5 to 15 atomic percent of Co.

5. The magnetic refrigeration material according to claim 1, in which the chemical composition includes 2 atomic percent or less and more than 0 atomic percent of oxygen.

6. The magnetic refrigeration material according to claim 1, phase region sizes of the material phases other than the $NaZn_{13}$ type crystal structure phase and the bcc crystal structure phase comprising Fe as the main constituent element are 20 μm or less.

7. The magnetic refrigeration material according to claim 1, in which main reflection line intensity ratio for $NaZn_{13}$ type crystal structure in powder X ray diffraction is 50 percent or more.

8. The magnetic refrigeration material according to claim 1, in which the magnetic refrigeration material is solidified by a forced cooling of a molten metal in a speed range of $1\times10^{4\circ}$ C./second to $1\times10^{8\circ}$ C./second.

9. The magnetic refrigeration material according to claim 1, in which the magnetic refrigeration material is solidified by a forced cooling of a molten metal and executed a heat-treatment of further increasing yield of $NaZn_{13}$ type crystal structure phase.

10. The magnetic refrigeration material according to claim 9, in which the heat-treatment is performed within 150 hours.

11. A method of manufacturing a magnetic refrigeration material as claimed in claim 1, comprising:

a melting process melting a raw material composition comprising at least one element selected from the group constituting of Y, La, Ce, Pr, Nd, Sm , Eu, Gd, Tb, Dy, Ho, Er, Tm and Yb in a total of 4 to 15 atomic percent; at least one element selected from members of the group constituting of Fe, Co, Ni, Mn and Cr in a total of 60 to 93 atomic percent; at least one element selected from members of the group constituting of Si, C, Ge, Al, Ga and In in a total of 2.5 to 23.5 atomic percent; and B of 0.5 atomic percent to 1.5 atomic percent into a molten metal; and a forced cooling process forcefully cooling and solidifying the molten metal and obtaining a rapidly cooled alloy comprising $NaZn_{13}$ type crystal structure phase.

12. The method of manufacturing the magnetic refrigeration material according to claim 11, in which the raw material composition comprises 5 to 15 atomic percent of La; 70 to 91 atomic percent of Fe; 3.5 to 18.5 atomic percent of Si; and 0.5 to 1.5 atomic percent of B.

13. The method of manufacturing a magnetic refrigeration material according to claim 11, in which the raw material composition comprises 80 atomic percent or more of Fe.

14. The method of manufacturing a magnetic refrigeration material according to claim 11, in which the raw material composition comprises 0.5 to 15 atomic percent of Co.

15. The method of manufacturing a magnetic refrigeration material according to claim 11, in which the molten metal comprises oxygen in a range of 2 atomic percent or less and more than 0 atomic percent.

16. The method of manufacturing a magnetic refrigeration material according to claim 11, in which the forced cooling process is cooled at a speed in a range from $1\times10^{4\circ}$ C./second to $1\times10^{8\circ}$ C./second.

17. The method of manufacturing a magnetic refrigeration material according to claim 11, further comprising a heat-treating process heat-treating and developing the $NaZn_{13}$ type crystal structure phase after the forced cooling.

18. The method of manufacturing a magnetic refrigeration material according to claim 17, in which the heat-treating process is executed for less than 150 hours.

19. The method of manufacturing a magnetic refrigeration material according to claim 11, in which phase region sizes of the material phases other than the $NaZn_{13}$ type crystal structure phase and the bcc crystal structure phase comprising Fe as the main constituent element are suppressed to 20 μm or less.

20. The method of manufacturing a magnetic refrigeration material according to claim 11, in which main reflection line intensity ratio of the manufactured magnetic refrigeration material in powder X ray diffraction is increased to 50 percent or more.

* * * * *